United States Patent [19]

Jette

[11] 4,273,289

[45] Jun. 16, 1981

[54] SHOWERHEAD SPRAY TEXTURE CONTROL

[76] Inventor: Emile Jette, 1328 NE. 110 Ter., Miami, Fla. 33161

[21] Appl. No.: 868,200

[22] Filed: Jan. 9, 1978

Related U.S. Application Data

[63] Continuation-in-part of Ser. No. 863,694, Dec. 20, 1977, abandoned, which is a continuation-in-part of Ser. No. 818,441, Jul. 25, 1977, abandoned, which is a continuation-in-part of Ser. No. 790,277, Apr. 25, 1977, abandoned, which is a continuation-in-part of Ser. No. 743,766, Nov. 22, 1976, abandoned.

[51] Int. Cl.[3] ..... B05B 1/18; B05B 1/32

[52] U.S. Cl. ..... 239/458; 239/460; 239/539; 239/578; 239/579; 239/587

[58] Field of Search ..... 239/436–449, 239/457–458, 460, 525, 537, 578, 579, 587, 538, 539, 541, 574; 4/145, 146, 148, 151, 153–155, 596, 597, 604, 605, 612; 235/261, 271; 251/293; D23/35

[56] References Cited

U.S. PATENT DOCUMENTS

| | | | |
|---|---|---|---|
| D. 161,431 | 1/1951 | Derbyshire | D23/35 |
| D. 208,244 | 8/1967 | Poole | D23/35 |
| 595,014 | 12/1897 | Doolittle | 239/537 X |
| 2,285,831 | 6/1942 | Pennypacker | 239/460 |
| 3,047,239 | 7/1962 | Canavan | 239/460 X |
| 3,358,934 | 12/1967 | Moen | 239/443 |

FOREIGN PATENT DOCUMENTS

| | | | |
|---|---|---|---|
| 353605 | 10/1937 | Italy | 239/587 |
| 192084 | 1/1924 | United Kingdom | 239/587 |

*Primary Examiner*—Andres Kashnikow
*Attorney, Agent, or Firm*—Bacon & Thomas

[57] ABSTRACT

A showerhead for controlling both water flow, spray direction and spray texture including a main housing for pivotally connecting same to a water supply line such that water flow is permitted through the showerhead in at least one pivoted position and terminated in at least one other pivoted position. A spray control carried by the showerhead permits varying spray texture and an elongate control rod having one end carried by the showerhead and a second free distal end for manual actuation by the user to pivot the showerhead about its connection to the water supply line to control water flow therethrough and actuate the spray control upon rotation of the control rod about its longitudinal axis.

23 Claims, 13 Drawing Figures

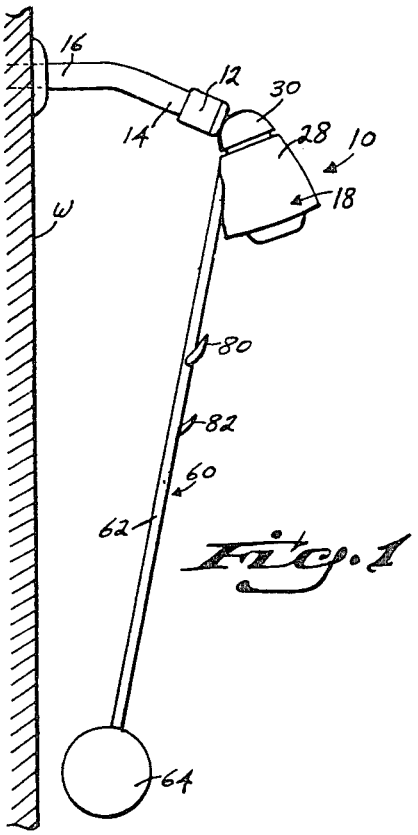
Fig. 1
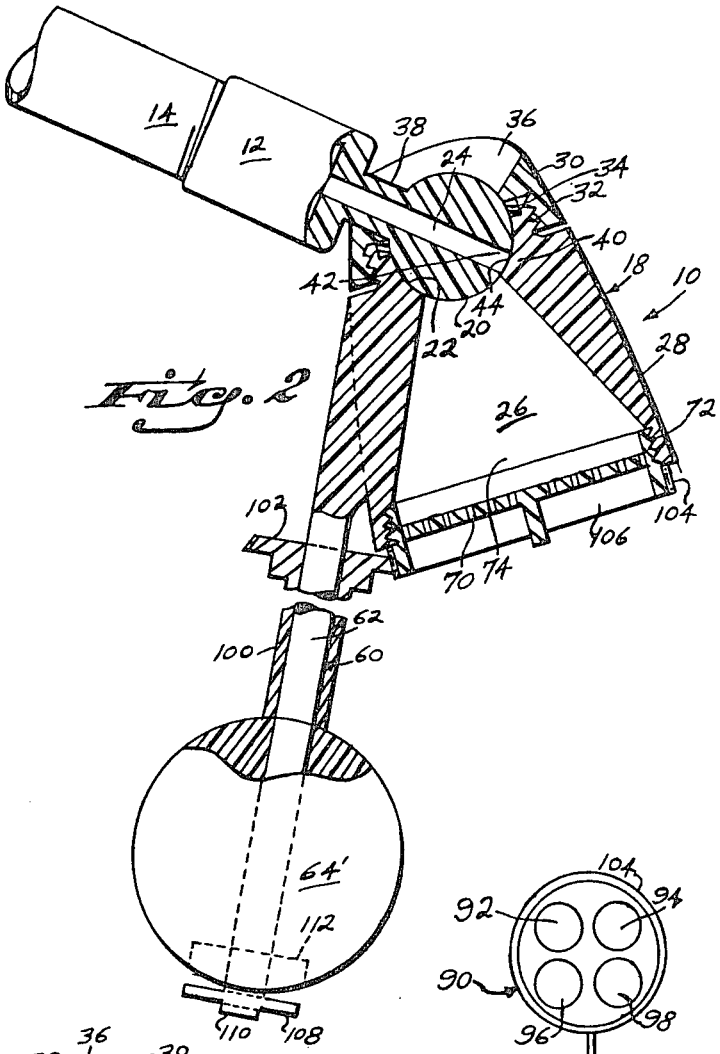
Fig. 2
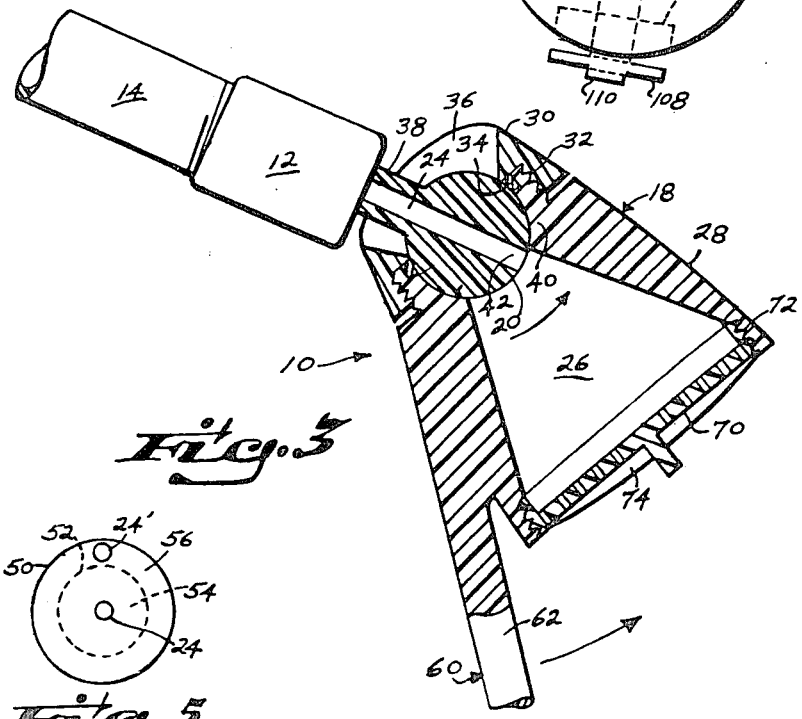
Fig. 3
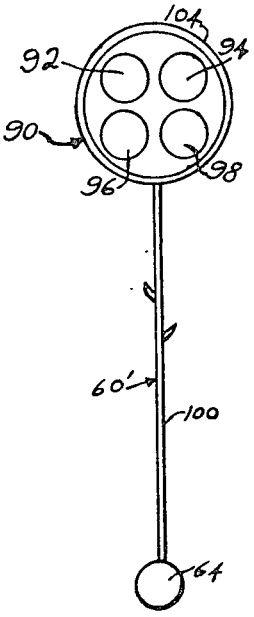
Fig. 4
Fig. 5

SHOWERHEAD SPRAY TEXTURE CONTROL

CROSS-REFERENCES TO RELATED APPLICATIONS

This application is a continuation-in-part of application Ser. No. 863,694, filed Dec. 20, 1977, now abandoned, which in turn is a continuation-in-part of application Ser. No. 818,441, filed July 25, 1977, now abandoned, which in turn is a continuation-in-part of application Ser. No. 790,277, filed Apr. 25, 1977, now abandoned, which in turn is a continuation-in-part of application Ser. No. 743,766, filed Nov. 22, 1976, now abandoned.

BACKGROUND OF THE INVENTION

1. Field of the Invention

The present invention generally relates to showerheads for distributing water received from a water supply line. More particularly, the invention relates to showerheads having means for controlling the direction of water flow and water spray texture.

2. Description of the Prior Art

Showerheads are generally connected to a source of water supply by a ball and socket connection, the ball being fixed to the end of a water supply pipe, projecting outwardly of a wall in a bathtub or shower enclosure. The socket connection is provided in the showerhead in a manner so as to permit universal movement of the showerhead, relative to the fixed ball, within predetermined limits.

Generally, individual hot and cold water faucets or a single lever type of faucet is connected to hot and cold water conduits from sources of supply. The faucet or faucets must be manipulated to a proper hot and cold water mixture to achieve a desired water temperature. The mixed water then enters a single conduit to the showerhead where it passes through a discharge port in the connector ball and then outwardly in a spray form through any one of a variety of spray structures, depending upon the maker of the spray head. A newer type of spray head provides a plurality of spray outlets, three or four for example, with manual adjustment means to direct the mix of hot and cold water to the single outlet port in the connector ball to the desired spray outlet.

To adjust the direction of the spray, a user must physically grasp any of the single or multiple outlet spray heads, provided with the above described ball and socket connections, and turn it to a desired position. If a user desires to shut off the water supply while applying soap or shampoo, the faucet or faucets must be turned off and then turned on and readjusted to the desired hot and cold water mixture for the rinsing operation. Since bathtub and shower enclosures are generally limited in size, it is very difficult to avoid the shower spray while applying soap or shampoo.

SUMMARY OF THE INVENTION

The present invention solves the aforementioned problems of known devices by providing an improved showerhead which is capable of controlling water flow, spray direction and spray texture by the manual actuation of a single elongate control rod at a distance from the showerhead. The showerhead basically comprises an housing having a passage therethrough with means for pivotally connecting the inlet of the passage to a water supply line such that the housing is capable of universal pivoting movement within predetermined limits to permit water flow through the passage in at least one pivoted position and terminate water flow through the passage in at least one pivoted position. A spray control means is connected to the outlet end of the flow passage for varying spray texture. An elongate control rod is provided with a first end carried by the housing and a second free distal end, with the longitudinal axes of the control rod and the flow passage diverging outwardly from the showerhead. Manual actuation of the control rod at its free distal end by a user permits pivoting the main housing about its connection to the water supply line to control water flow through the passage and spray direction, with spray texture being controlled upon rotation of the control rod about its longitudinal axis.

In another embodiment of the invention, the control rod is defined by a generally open framework wheel of substantial diameter and having a plurality of elongate spokes. The showerhead is controlled by grasping the rim of the wheel and pivoting the housing about its connection to control water flow through the passage and spray direction. Moreover, control of spray texture is effected by rotating the wheel about its central connection axis to the housing.

Therefore, one of the principal objects of the present invention is to provide an improved showerhead having a control rod that includes a distal handle portion which, upon actuation, serves to not only control water flow through the showerhead and spray direction, but also spray texture.

Another object of the invention is to provide a showerhead capable of terminating water flow therethrough and subsequently permitting water flow therethrough at the same original water temperature.

It is a further object of the invention to provide an improved showerhead which is capable of controlling water flow, spray direction and spray texture through the manual actuation of a single control means at a distal point at all times away from the water spray.

These and other objects and advantages of the present invention will become apparent to those skilled in the art by reference to the following description of preferred embodiments thereof when taken in conjunction with the accompanying drawings wherein like reference characters refer to like elements throughout the views.

BRIEF DESCRIPTION OF THE DRAWINGS

FIG. 1 is a side elevational view of the showerhead control device of the present invention;

FIG. 2 is an enlarged fragmentary view of the device of FIG. 1 in a "water-off" position and depicting the water texture control means, with parts broken away to illustrate the structural details thereof;

FIG. 3 is a view similar to FIG. 2 in a "water-on" position;

FIG. 4 is a front elevational view illustrating the invention in combination with a showerhead provided with a plurality of spray outlets;

FIG. 5 is a schematic illustration of the range of movement of the showerhead of FIG. 2 and further illustrating the "water-on" and "water-off" zones within the movement range;

DETAILED DESCRIPTION OF THE PREFERRED EMBODIMENTS

Figure 6:
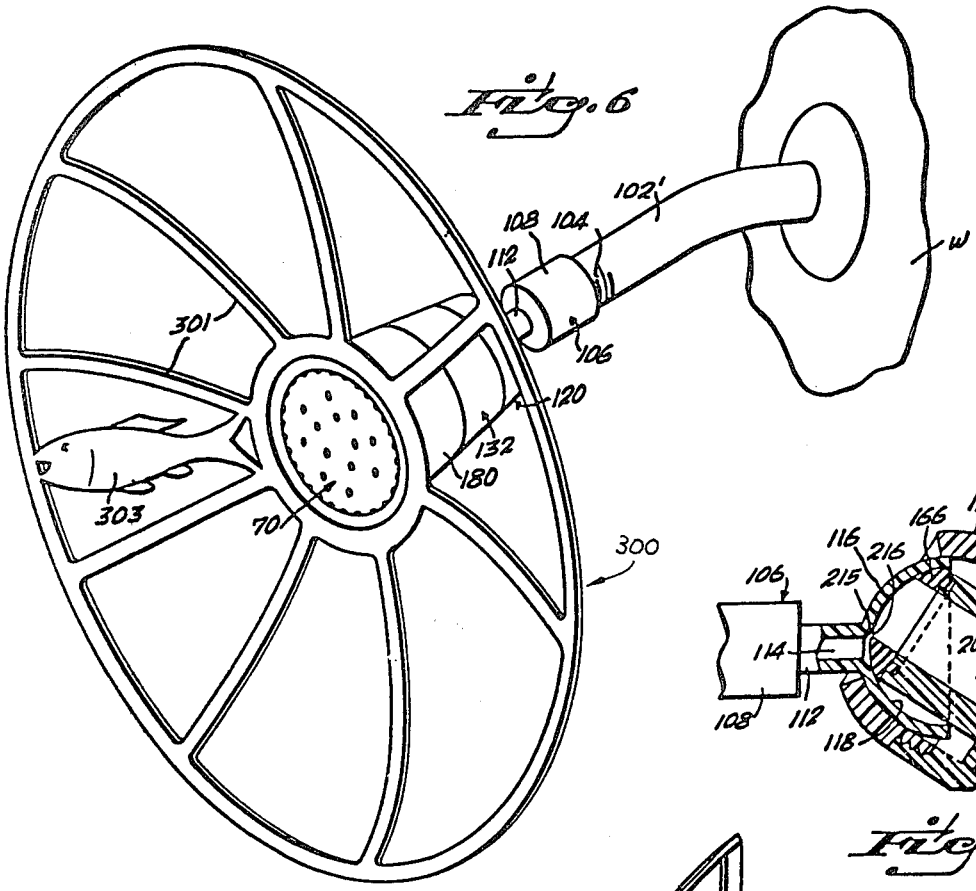
FIG. 6 is a perspective view of a second embodiment of the invention.

With particular reference to FIG. 1, the showerhead assembly including the control device of the present invention is indicated at 10. The showerhead is coupled at 12 to the discharge end 14 of a water supply conduit portion 16 extending from a wall W in a bathtub or shower enclosure in a conventional manner.

The assembly 10 includes a showerhead 18 connected to a ball 20 fixed in any conventional manner to the coupling 12. The ball 20 is universally journaled in a socket 22 in the showerhead 18 and includes a water discharge port 24 normally opening into a chamber 26 in the showerhead 18 as seen in FIG. 3.

The showerhead 18 includes an enlarged lower portion 28 defining the chamber 26 and socket 22, and a cap portion 30 screw-threaded at 32 onto the upper end of lower portion 28 to captivate the showerhead 18 on the ball 20, forming a ball and socket joint to permit a limited amount of universal movement of showerhead 18 relative to ball 20 in a manner to be hereinafter described. A seal ring 34 is interposed between lower portion 28 and cap 30 at the screw-threaded connection 32 to seal against water leakage and to provide a desired degree of frictional engagement with the ball 20.

As illustrated in FIGS. 2 and 3, a top central portion of cap 30 is cut out as at 36 in a generally funnel-shaped configuration for passage therethrough of a neck portion 38 of ball 20 into fixed engagement with conduit 16 by means of coupling 12. Port 24 extends into open communication through ball 20 and neck portion 38 between chamber 26 and the supply conduit 16. The cap cut out 36 is substantially enlarged relative to neck 38 to permit a predetermined degree of universal movement of the showerhead 18 relative to ball 20. Chamber 26 is configured to define a thickened annular wall portion at 40 immediately adjacent the socket 22. The size of socket 22 cooperates with the size of the cap cut out 36 to permit the showerhead to be pivoted to the position illustrated in FIG. 2 wherein the discharge end 42 of port 24 is closed by the socket wall as at 44. When the showerhead 18 is moved to the position of FIG. 3, the discharge end 42 is open into chamber 26 to discharge water therethrough.

FIG. 5 illustrates schematically the water "on" and "off" zones. Outer solid line 50 illustrates the maximum degree of universal movement of the showerhead 18. The inner broken line 52 defines an annular inner zone 54 in which the water is turned "on", the peripheral ring area 56 defines the water "off" zone, with the port being indicated at 24 and 24'. Socket 24 therefore comprises both a journal and valve means.

An elongated, generally downwardly extending handle 60 is provided from the enlarged lower portion 28 of showerhead 18. Handle 60 may be comprised of a rod 62 terminating at its extended end with an enlarged portion such as ball 64. The handle 60 including ball 64 may be formed integral with lower portion 28, particularly when the device is formed of a suitable plastic material, or the portion 28, rod 62 and ball 64 may be separately formed and provided with, for example, screw-threaded connections.

A spray creating means 70, in the form of a perforated disc, is in screw-threaded connection at 72 with the discharge end 74 of the lower portion 28 of showerhead 18.

Hook means such as 80 and 82 may be formed on or fixed to handle rod 62 for the purpose of suspending bath items therefrom.

FIG. 4 schematically illustrates a multiple outlet showerhead 90 incorporating the control means of the present invention. A plurality of spray outlets 92, 94, 96 and 98 are each provided with the ball and socket connection, valve means as above described, and control handle 60'.

In use, the handle 60 may be moved to the peripheral zone 56, as illustrated in FIG. 5, such as rearwardly toward the wall W as in FIG. 1 to shut off the shower spray, or to any selected position within the annular inner zone 54 to turn on the shower spray.

FIG. 2 illustrates a modification of the showerhead control device of the present invention in which the ball 64' is separate from the rod 62 and includes an elongated sleeve 100 extending generally upwardly therefrom in telescopic engagement over rod 62. At its upper end, sleeve 100 includes a pinion gear 102 fixed or formed integral therewith for selective engagement or disengagement with a ring gear 104 formed about the extended portion 106 of perforated disc 70.

Pinion gear 102 is slidable into the engaged position of FIG. 2 by means of ball 64' or to a disengaged, down position wherein a clutch pin 108 extending through the distal end portion 110 of ball 64' engages in a slot 112 in ball 64'. Ball 64' is thereby held relative to rod 62 and functions in a manner so as to provide selective positioning of the showerhead and operation of the valve means to "on-off" positions as above described. In the gear engaged position of FIG. 2, the ball 64' may be rotated to move the spray texture control means 70 inwardly or outwardly by means of screw thread 72 depending upon the direction of operation of pinion 102 by ball 64'.

Figure 8:
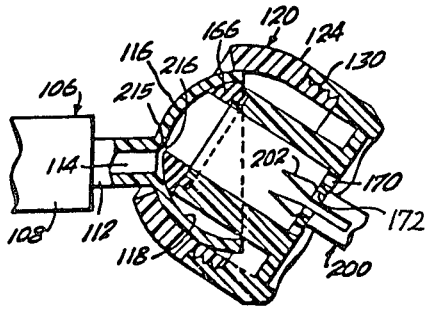
FIG. 8 is a fragmentary view taken in cross section illustrating the operation of the embodiment shown in FIGS. 6 and 7.
Figure 7:
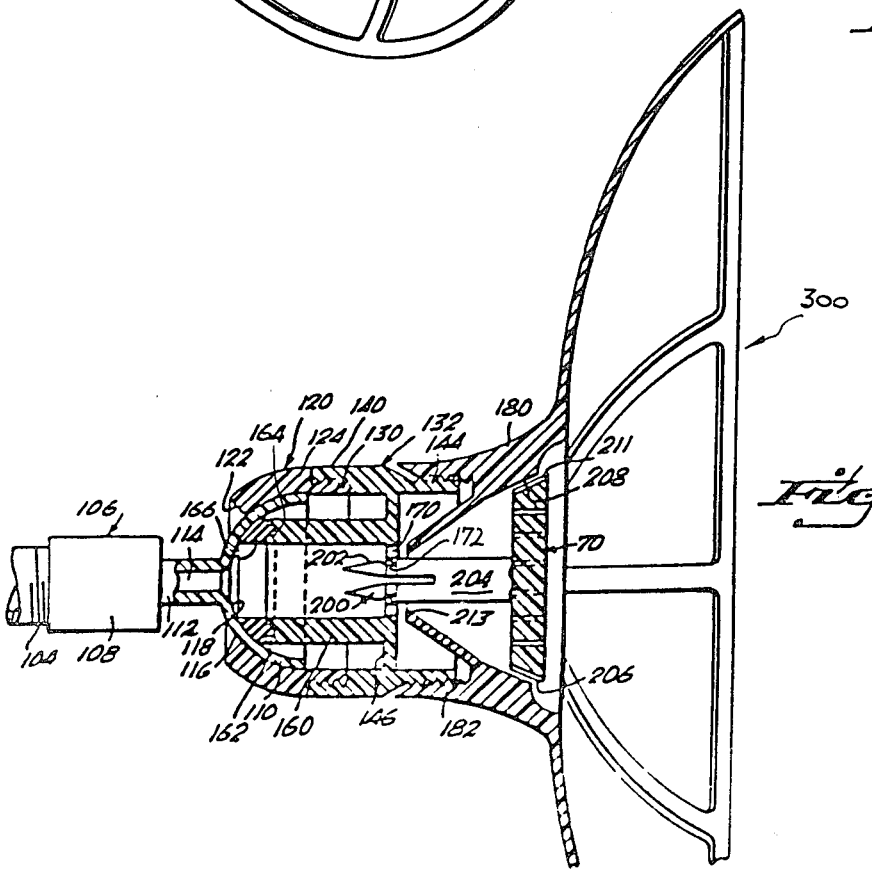
FIG. 7 is a view in cross section illustrating the interior assembly and working parts of the embodiment depicted in FIG. 6.

Referring now to FIGS. 6–8, there is depicted a second embodiment of the invention wherein the shower water supply line 102' is threaded at 104 on its terminal end and there is provided a fitting generally designated at 106. Fitting 106 includes a first end zone 108 and a second end zone 110 which are interconnected by a stem 112. A passageway 114 extends through fitting 106. The first end zone 108 is internally threaded for engagement with threaded end 104. The second end 110 includes an outwardly facing ball segment providing an internal valve surface 118 and an external surface 116.

An adaptor 120 is provided with an opening 122 having a diameter larger than first end zone 108 of the fitting 106 for permitting axial positioning of the same therethrough and with a nose zone 124 which is correspondingly configured in a semispherical form for captive engagement of the outwardly curved second end zone 110 of the fitting 106. As shown in FIG. 8, adaptor 120 is permitted a limited range of universal rotational movement relative to first end zone 108. The end 130 of adaptor 120 is provided with exterior threads for engagement with a member 132. The member 132 includes an inner end 140 and an outer end 144. The inner end 140 is internally threaded for engagement with threaded end 130 of adaptor 120 while the other end 144 is threaded exteriorly for engagement with a showerhead.

A web 146 is provided in spanning relation of the interior of the member 132 and includes an axially projecting tube defining portion 160 having a terminal end at 162 with a seat 164 defined therein and sized to receive an annular washer 166 nested therein which, in assembly, is in abutting engagement with the interior surface of the curved second end 110 of fitting 106. Water passes through a diffuser web having a plurality of openings arranged in an annular pattern which is generally designated by the numeral 170. As also shown, web 146 is provided with a central through opening 172.

The showerhead comprises a body 180 having an exterior ring gear surface which is generally decorative and includes an axially facing opening 182 for threaded engagement with the end 144 of member 132. A barbed terminal end 200 of a water selection disc 70 is captivated through opening 172 in web 146, with the end 200 having a barbed surface as at 202 which engages through opening 172 in web 146 and is carried on a stem 204 and a distally disposed water selection disc 70, the latter provided with an exterior frustoconical-shaped surface 206. The interior of body 180 includes a correspondingly configured frustoconical surface 208. When the body 180 is screwed or unscrewed on threaded end 144 of member 132, surface 208 moves towards or away from surface 206, thereby defining a variable annular passageway between the surfaces. As also shown in FIG. 7, surface 206 includes a plurality of peripheral grooves 211 such that, when surface 208 is in an advanced position, the path of water flow travels through a minimum opening between surface 208 and annular grooves 211. When body 180 is advanced in the opposite direction, a skirt 213 is brought into substantially, but not complete closing relationship with the pattern of annular openings 170 in web 146, thus controlling not only the amount of water flow, but also spray texture.

As also shown in FIG. 8, a beveled surface 215 is provided so that there is at all times a passageway 216 for permitting a small flow or trickle of water, even though the device is maintained in closed position. While in the position shown in FIG. 7, the passageway is in its full open position.

As is apparent, by grasping control means 300 and manipulating same, water flow and spray direction can be controlled by pivoting member 132 with respect to water supply line 102. Upon rotation of control means 300, spray texture can also be varied by advancing body 180 towards or away from member 132. As further seen in FIG. 6, operator means 300 may include a plurality of spokes 301 and, additionally, a spoke of distinctive design 303, being in the shape of a fish. It will be seen that by selecting the orientation of spoke 303, the spray texture of the water may be easily selected by a person familiar with the operation of the invention.

Figure 9:
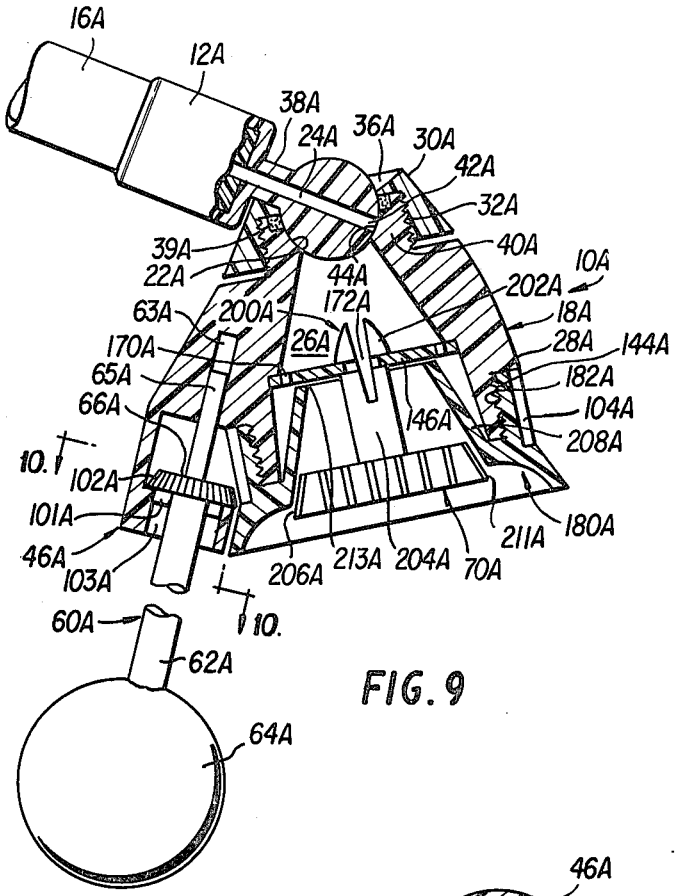
FIG. 9 is an enlarged fragmentary view of a third embodiment of the invention depicting the showerhead in a "water-off" position and with the spray texture control means in a position of coarse spray, with parts broken away to illustrate the structural details thereof.

A third embodiment of the invention is depicted in FIG. 9 wherein the showerhead 10A includes an elongate control rod 60A. Showerhead 10A is coupled at 12A to the discharge end 14A of a water supply conduit 16A, the latter extending from a wall in a bathtub or shower enclosure.

Assembly 10A includes a showerhead 18A connected to a ball 20A fixed in any conventional manner to the coupling 12A. The ball 20A is universally journaled in a socket 22A in the showerhead 18A and includes a water discharge port 24A normally opening into a chamber 26A in the showerhead 18A, with the latter being depicted in FIG. 9 in a fine spray position.

The showerhead 18A includes an enlarged lower portion 28A configured to define a thickened wall 40A immediately adjacent socket 22A. Showerhead 18A also includes a bearing housing 46A which receives an end 65A of elongate control rod 60A. End 65A is slidably received and journaled for rotation within recess 63A. A pinion gear 102A is also provided on end 65A for engagement and disengagement with a ring gear 104A upon reciprocation of end 65A within recess 63A. A clutch 101A is disposed beneath pinion gear 102A for engagement within recess 103A when pinion gear 102A has been disengaged from ring gear 104A.

The inner wall sections of portion 28A define inner chamber 26A and socket 22A. A cap portion 30A is screw-threaded at 32A onto the upper end of portion 28A to secure showerhead 18A on the ball 20A, thereby forming a ball and socket joint to permit a limited amount of universal movement of showerhead 18A relative to ball 20A. A seal ring 34A is interposed between portion 28A and cap 30A at the screw-threaded connection 32A to seal against water leakage and to provide a desired degree of frictional engagement with the ball 20A.

A top central portion of cap 30A is cut out as shown at 36A in a generally funnel-shaped configuration for passage therethrough of a neck portion 38A of ball 20A into fixed engagement with conduit 16A by means of coupling 12A. Port 24A extends into open communication through ball 20A and neck portion 38A between chamber 26A and the supply conduit 16A. The cut out 36A is substantially enlarged relative to neck 38A to permit a predetermined degree of universal movement of the showerhead 18A relative to ball 20A. Chamber 26A is configured to define a thickened annular wall portion at 40A immediately adjacent to the socket 22A. The size of socket 22A cooperates with the ball 20A confronting surface and the size of the cap cut out 36A to permit the showerhead to be pivoted to the position as shown in FIG. 9 wherein the discharge end 42A of port 24A is closed by the thickened socket wall 40A as shown at 44A. When the showerhead 18A is pivoted upwardly from the position shown in FIG. 9, the discharge end 42A is then opened into chamber 26A to discharge water therein. Water from chamber 26A is passed through a diffuser web 146A having a plurality of openings arranged in an annular pattern which is generally designated by the numeral 170A. Web 146A is also provided with a central through opening 172A.

Showerhead 18A also includes a body 180A having an exterior control surface portion which is generally decorative and which has an axially facing opening 182A for threaded engagement with the corresponding end 144A of portion 28A. A barbed terminal end 200A of a water selection disc 70A is passed through central opening 172A and secured therein by virtue of barbed surface 202A, the latter being provided on a stem 204A of disc 70A. An exterior frustoconical-shaped surface 206A having a plurality of parallel grooves 211A is provided around the periphery of disc 70A. The interior of body 180A includes an inner correspondingly-shaped frustoconical surface 208A which is disposed substantially parallel to surface 206A. In this manner, when body 180A is screwed or unscrewed with respect to portion 28A, surfaces 206A and 208A define a variable annular passageway through which water is able to flow, with the ultimate spray texture being determined by the relative positioning of surfaces 206A and 208A. When in the advanced position axially away from the showerhead 18A, the path of water flow travels through a minimum opening surface 208A and annular grooves 211A of surface 206A. When the body 180A is advanced in the opposite direction, a skirt portion 213A is brought into substantially but not complete closing relationship to the pattern of annular openings 170A in web 146A, thus controlling not only the amount of water flow but also spray texture.

Figure 10:
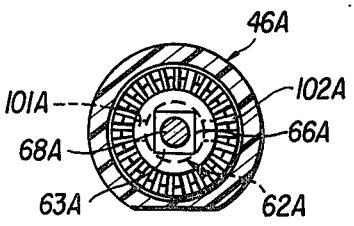
FIG. 10 is a view taken along the line 10—10 of FIG. 9.

Control rod 60A includes an extended member 62A, with first end 65A being of a smaller diameter than member 62A. End 65A is clutched in free movement in recess hole 63A in lower portion 28A, thereby providing leverage and restraining alignment of member 62A with respect to the axial center line of housing 46A. Referring more particularly to FIG. 10, a second end 66A of rod 60A includes a square shoulder on clutch 101A which engages a corresponding square opening 68A in recess 103A, thereby placing member 62A and recess 103A in clutched engagement.

Figure 11:
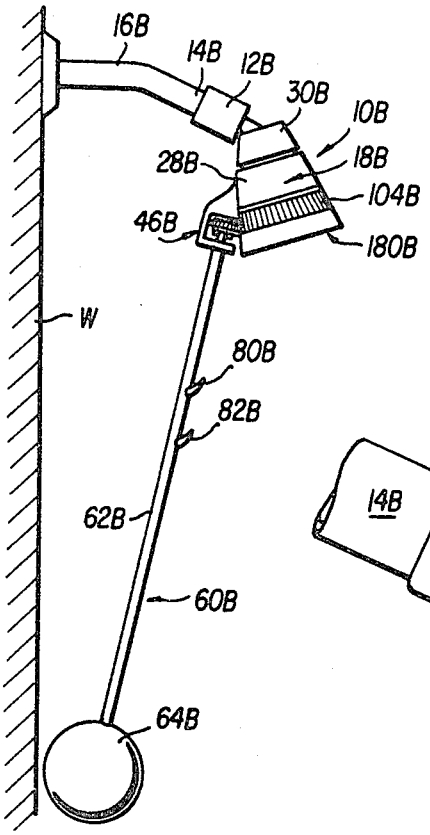
FIG. 11 is a side elevational view of a fourth embodiment of the present invention as installed with a conventional water supply pipe and depicting the showerhead in a "water-off" position.
Figure 12:
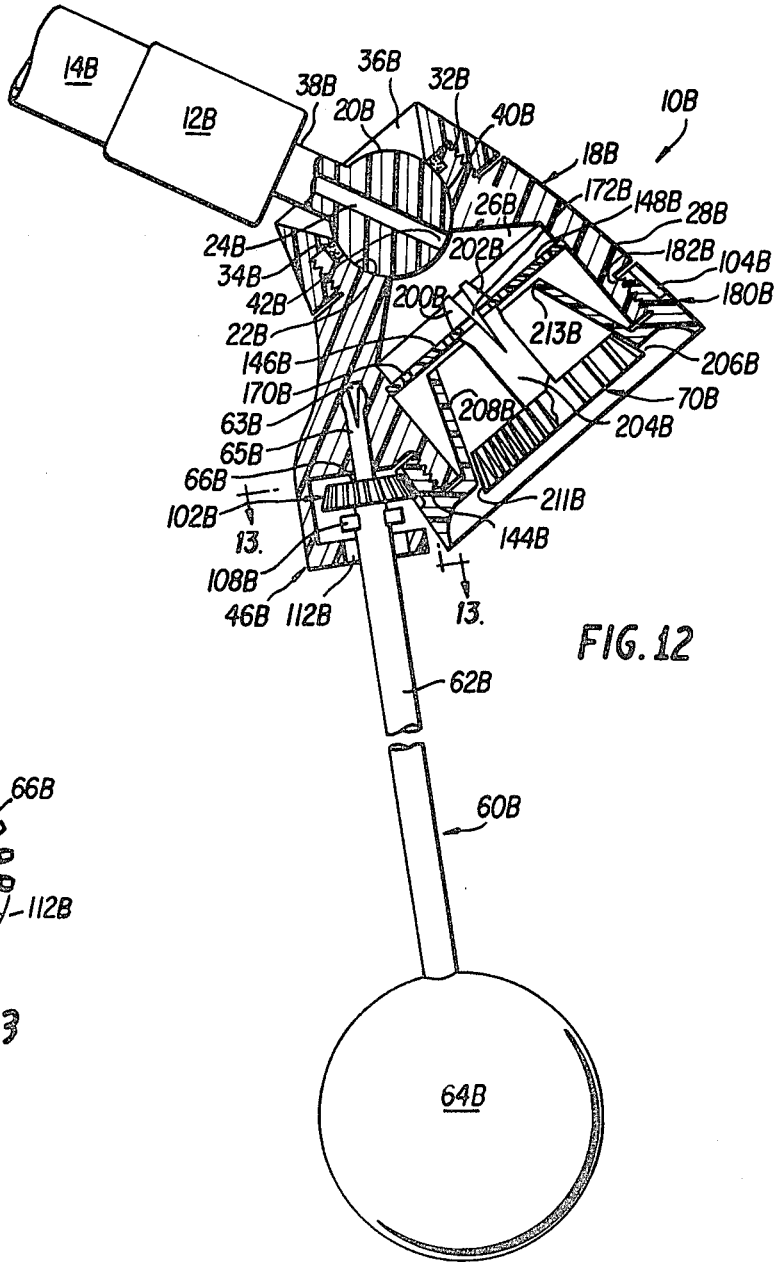
FIG. 12 is an enlarged fragmentary view of the embodiment shown in FIG. 11, with the showerhead in a "water-on" position.
Figure 13:
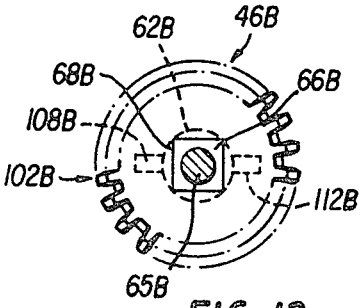
FIG. 13 is a view taken along the line 13—13 of FIG. 12.

A fourth embodiment of the invention, similar to the embodiment depicted in FIGS. 9 and 10, is shown in FIGS. 11–13. As seen in FIG. 11, the instant embodiment includes a showerhead assembly indicated generally at 10B and an elongate control operator 60B. Assembly 10B is coupled at 12B to the discharge end 14B of water supply conduit 16B extending from a wall associated with a conventional bathtub or shower enclosure.

Assembly 10B includes a showerhead 18B connected to a ball 20B fixed in any conventional manner to the coupling 12B. The ball 20B is universally journaled within a socket 22B in the showerhead 18B and includes a water discharge port 24B normally opening into a chamber 26B in the showerhead 18B as shown in FIG. 12. Showerhead 18B includes a main housing 28B having an extended operator 60B bearing end pinion 102B housing 46B, with slots 112B which engage with pinion clutch portions 108B. Housing 46B diverges with respect to the axial center line of showerhead 18B. Showerhead 18B is pivotally captured on ball 20B by means of a cap 30B which is threaded onto the upper inlet end of main housing 28B as shown at 32B. This arrangement defines a ball and socket joint which permits universal movement of showerhead 18B relative to ball 20B. A sealing ring 34B is interposed between main housing 28B and cap 30B at the threaded connection 32B to provide a desired degree of frictional engagement with ball 20B.

As also shown in FIG. 12, a top center portion of cap 30B is cut out as indicated at 36B in a generally funnel-shaped configuration for passage therethrough of a neck portion 38B of ball 20B into fixed engagement with conduit 16B by means of coupling 12B. Port 24B extends into open communication through ball 20B and neck portion 38B between chamber 26B and the supply conduits 16B. The cap cut out 36B is substantially enlarged relative to neck 38B to permit a greater predetermined degree of universal movement of the main housing 28B relative to ball 20B. Chamber 26B is configured to define a thickened annular wall portion at 20B immediately adjacent the socket 22B. The size of socket 22B cooperates with the size of the cap cut out 36B to permit the showerhead to be pivoted to a position such as shown in FIG. 11 wherein the discharge end 42B of port 24B is closed by the thickened socket wall portion 40B. When the showerhead 18B is pivoted to the position shown in FIG. 12, the discharge end 42B is opened into chamber 26B to discharge water therethrough. Water from chamber 26B passes through a diffuser partition 146B having a valve surface portion 148B which is generally designated by openings 170B. Partition 146B also includes a control through opening 172B.

Showerhead 18B includes an annular valve body 180B having an exterior control surface which is generally decorative and has an axially facing opening screw threaded at 182B for engagement with the threaded end 144B of housing 28B. A barbed terminal end 200B of a water selection disc 70B is secured through opening 172B in partition 146B. End 200B includes a barbed surface at 202B which engages through opening 172B in partition 146B, which surface 202B is carried on a stem 204B of disc 70B, the latter being provided with an exterior frustoconical-shaped peripheral surface 206B. The interior of body 180B includes an inner correspondingly shaped frustoconical surface 208B which defines a variable annular opening with surface 206B when body 108B is screwed on or off housing 28B.

When body 180B is in an advanced position axially away from the showerhead 18B, the path of the water travels through a constricted minimum opening between surface 208B and a plurality of annular grooves 211B provided on surface 206B. When the body 180B is advanced in the opposite direction, a frustoconical skirt-shaped portion 213B carried by body 180B is caused to move towards partition 146B wherein it is brought into substantially closing relation to the valve surface portion 148B inside the inner annular pattern of openings 170B of partition 146B, thus controlling not only the spray texture but also the volume of water flow. As is thus apparent, the user may manipulate operator 60B to cause the showerhead body 180B to advance or be withdrawn thereby varying the spray texture of the water being dispersed from the showerhead. Manipulation of operator 60B will also cause the amount of water flow through the showerhead to be controlled between a substantially "off" position to a fully "open" position.

An elongate operator 60B includes a rod member 62B terminating at its extended distal end with an enlarged portion such as control hand grip 64B. The other end of operator 60B is operatively connected within housing 46B and includes a first upper end 65B and a second upper end 66B. Hand grip 64B may be of any suitable plastic material formed integrally with rod 62B or be in the form of a separate member connected thereto.

First upper end 65B includes a barbed terminal end which is frictionally clutched within a recess 63B formed in portion 28B. In this manner, rod 62B is restrained and aligned with respect to the axial center line of housing 46B.

As shown in FIG. 13, second upper end 66B includes a square shoulder for engagement with a square opening 68B in pinion gear 102B, thereby placing rod 62B and pinion gear 102B in engagement for transferring torque applied by control rod 62B to ring gear 104B.

As shown in FIG. 12, pinion gear 102B is placed into engagement with ring gear 104B upon pushing first upper end 65B of control rod 62B into recess 63B. Disengagement of pinion 102B from ring gear 104B is achieved by pulling upper end 65B from recess 63B so that a pinion gear clutch portion 108B will drop downwardly and engage within a recess slot 112B formed in bearing housing 46B. When the latter position has been achieved, control rod 62B will be securely held within housing 46B and thereby permit the user to manipulate handle 64B for the purpose of pivoting showerhead 18B about ball 20B for the purpose of establishing spray direction. In the position wherein pinion gear 102B is engaged with ring gear 104B as shown in FIGS. 11 and 12, hand grip 64B may be manipulated so that control rod 62B is rotated about its longitudinal axis either clockwise or counterclockwise to advance or retract body 180B with respect to disc 70B, thereby controlling water spray texture.

As also shown in FIG. 11, hooks 80B and 82B may be integrally formed with or attached to control rod 62B for the purpose of suspending bath items therefrom. When it is desired to terminate water through showerhead 18B, hand grip 64B may be pushed towards wall W as shown in FIG. 11 so that flow through ball 20B is terminated by the thickened section 40B of housing 28B. When flow is reestablished, the exact original water temperature is realized without the necessity of readjusting the water supply line faucets.

It is to be understood that the forms of the invention herein shown and described are to be taken as preferred examples of the same, and that various changes in shape, size and arrangement of parts may be resorted to, without departing from the spirit of the invention or scope of the subjoined claims.

What is claimed is:

1. A showerhead comprising, in combination:

(a) a main housing having a longitudinal passage therethrough with inlet and outlet ends;

(b) means for connecting the main housing at the inlet end of the passage to a water supply line to permit substantially universal pivotal movement of the main housing with respect to the water supply line, whereby water flow through the passage is permitted in at least one pivoted position and terminated in at least one other pivoted position;

(c) an elongate control rod having a first end carried by the main housing and a second free distal end for pivoting the main housing about its pivotal connection to the water supply line to control water flow through the passage and spray direction; and (d) wherein the longitudinal axes of the control rod and flow passage diverge outwardly from the showerhead to locate the second free distal end at all times away from contact by water spray from the showerhead.

2. The showerhead of claim 1 wherein:

(a) the first end of the elongate control rod includes:

i. a barbed terminal defining a first upper portion, and ii. connector means defining a second upper portion; and (b) a handle carried by the second free distal end.

3. A showerhead comprising, in combination:

(a) a main housing having a longitudinal passage therethrough with inlet and outlet ends;

(b) means for pivotally connecting the main housing at the inlet end of the passage to a water supply whereby water flow through the passage is permitted in at least one pivoted position and terminated in at least one other pivoted position;

(c) spray control means at the outlet end of the flow passage for varying spray texture; and (d) an elongate control rod having a first end carried by the main housing and a second free distal end, wherein the longitudinal axes of the control rod and the flow passage diverge outwardly from the showerhead, for:

i. pivoting the main housing about its pivotal connection to the water supply line to control water flow through the passage and spray direction, and ii. actuating the spray texture control means upon rotation of the control rod about its longitudinal axis.

4. The showerhead of claim 3 wherein the means for pivotally connecting the main housing to the water supply line includes a ball and socket assembly.

5. The showerhead of claim 4 wherein the pivotal connection further includes a cap for threaded attachment to the main housing and the socket is at least in part defined by an interior wall section of the main housing.

6. The showerhead of claim 3 wherein the control rod includes a handle adjacent the second free distal end.

7. The showerhead of claim 3 wherein the control rod further includes means disposed along the length thereof for supporting articles.

8. The showerhead of claim 7 wherein the supporting means includes at least one hook.

9. The showerhead of claim 3 further including means to permit a water flow trickle leak when the main housing is in the at least one other pivoted position for preventing cross flow of any water sources being fed to the water supply line.

10. The showerhead of claim 3 wherein the spray control means includes:

(a) a stationary member, and (b) a movable member spaced from the stationary member for defining a variable annular spray passageway therebetween.

11. The showerhead of claim 10 wherein:

(a) the stationary member includes a disc provided with a plurality of grooves in its peripheral surface, and (b) the movable member is threadedly attached to the main housing and includes an interior wall surface disposed substantially parallel to the peripheral surface of the disc.

12. The showerhead of claim 10 further including a porous diffuser web disposed transversely of the passage, with the stationary member being supported by and spaced from the diffuser web.

13. The shower head of claim 12 wherein:

(a) the porous diffuser web includes a central opening, and (b) the stationary member includes a barbed portion for interlocking through the central opening.

14. The showerhead of claim 10 wherein:

(a) the movable member includes a ring gear, and (b) the first end of the control rod includes a pinion gear for engaging the ring gear and transmitting rotational movement of the control rod thereto.

15. The showerhead of claim 14 further including a secondary housing carried by the main housing and wherein the first end of the control rod is journaled within the secondary housing for:

(a) rotary movement upon rotation of the control rod, and (b) reciprocating movement when the control rod is pushed and pulled to engage and disengage the pinion gear with respect to the ring gear.

16. The showerhead of claim 15 wherein the first end of the control rod includes a barbed portion for locking the first end of the control rod to the secondary housing while permitting rotation of the control rod during engagement of the pinion gear to the ring gear.

17. The showerhead of claim 15 wherein:

(a) the secondary housing includes a recess, and (b) the first end of the control rod includes a clutch portion for engaging the recess when the control rod is pulled to disengage the pinion gear from the ring gear.

18. The showerhead of claim 15 wherein:

(a) the control rod includes a telescoping sleeve, and (b) the pinion gear is carried by the telescoping sleeve.

19. A showerhead comprising, in combination:

(a) a main housing having a longitudinal passage therethrough with inlet and outlet ends;

(b) means for pivotally connecting the main housing at the inlet end of the passage to a water supply line whereby water flow through the passage is permitted in at least one pivoted position and terminated in at least one other pivoted position;

(c) spray control means at the outlet end of the flow passage for varying spray texture; and (d) a wheel carried by the spray control means and including a plurality of elongate spokes, wherein the longitudinal axis of each spoke and the longitudinal axis of the flow passage diverge outwardly from the showerhead, for:

i. pivoting the main housing about its pivotal connection to the water supply line to control water flow through the passage and spray direction, and ii. actuating the spray texture control means upon rotation of the wheel.

20. The showerhead of claim 19 wherein the wheel includes a rim joining the spokes together.

21. The showerhead of claim 19 further including means carried by the wheel for indicating a given position of rotation.

22. The showerhead of claim 19 wherein the pivotal connection means includes:

(a) a semispherical segment having an internal valve surface, and (b) a semispherical member disposed interiorly of the semispherical segment for contacting the internal valve surface.

23. The showerhead of claim 22 wherein the portion of the semispherical member contacting the internal valve surface includes a washer.

* * * * *